US006116775A

United States Patent [19]

Masateru

[11] Patent Number: 6,116,775

[45] Date of Patent: Sep. 12, 2000

[54] CLOCK ASSEMBLY HAVING MAGNETIC ORNAMENTS

[76] Inventor: Takahira Masateru, 1-B, 4-17-6 Sunrise Chuo Nakanoku, Tokyo, Japan

[21] Appl. No.: 09/229,577

[22] Filed: Jan. 13, 1999

[51] Int. Cl.[7] ..... G04B 37/00

[52] U.S. Cl. ..... 368/285; 368/10; 368/223; 368/165; 368/179

[58] Field of Search ..... 368/10, 76, 80, 368/165, 166, 179, 223, 272, 273, 278, 285

[56] References Cited

U.S. PATENT DOCUMENTS

| | | | |
|---|---|---|---|
| 3,461,665 | 8/1969 | Cielaszyk | 368/179 |
| 5,159,583 | 10/1992 | Lee | 368/223 |
| 5,272,681 | 12/1993 | Lee | 368/285 |
| 5,850,373 | 12/1998 | Lee | 368/285 |

OTHER PUBLICATIONS

German Patent No. 30350, Figures 1–3, no date.

*Primary Examiner*—Diego Gutierrez
*Assistant Examiner*—Jeanne-Marguerite Goodwin
*Attorney, Agent, or Firm*—Dougherty & Troxell

[57] ABSTRACT

A clock assembly having magnetic ornaments, including a power device, and a base. The power device includes a core having a time indication output and an induction coil at a lower portion thereof, and a swing lever pivotally connected to a rear side thereof by means of a pivot shaft capable of relative movement. The swing lever has an intermediate section provided with an ornament magnet corresponding to the induction coil at the lower portion of the core, and a lower end having a forwardly bent lever plate. The lever plate has a lever magnet provided thereon. The swing lever further has a swing ornament disposed at a top end thereof. The base is a hollow housing accommodating and securing therein the power device. An upper portion of the base is provided with a window adapted to correspond to the time indication output. A lower portion thereof extends forwardly to form a base platform. At least one base ornament is disposed on the base platform. The base ornament has a swingable portion and is connected by means of a pivot. A bottom portion of the base ornament is provided with an ornament magnet. The base further has a notch at a top end thereof for passage of the swing lever. The induction coil and the swing magnet cooperate to cause the swing lever to swing to thereby cause the swing ornament to swing. The magnetic action of the lever magnet at the lower end of the swing lever causes the movable portion of the base ornament to move upwardly and downwardly.

10 Claims, 4 Drawing Sheets

CLOCK ASSEMBLY HAVING MAGNETIC ORNAMENTS

BACKGROUND OF THE INVENTION (a) Field of the Invention

The present invention relates to a clock assembly that is provided with magnetic ornaments capable of motion.

(b) Description of the Prior Art

There are many different kinds of clocks available on the market. Some clocks are provided with magnetic elements to achieve a dynamic action so as to give variety to the clock and enhance the appearance thereof. Conventional clocks with magnetic elements usually move according to a predetermined pattern, and the principle employed is the use of magnetic attraction or repulsion to generate a unidirectional rhythmic motion. For consumers who like novel and interesting assemblies, such conventional clocks are still not satisfactory.

SUMMARY OF THE INVENTION

A primary object of the present invention is to provide a clock assembly having magnetic ornaments that is capable of motions in different directions to make the clock assembly more interesting.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

A preferred embodiment of a clock assembly having magnetic ornaments according to the present invention comprises a power device 1, a base 2, and a back cover 3.

Figure 1:
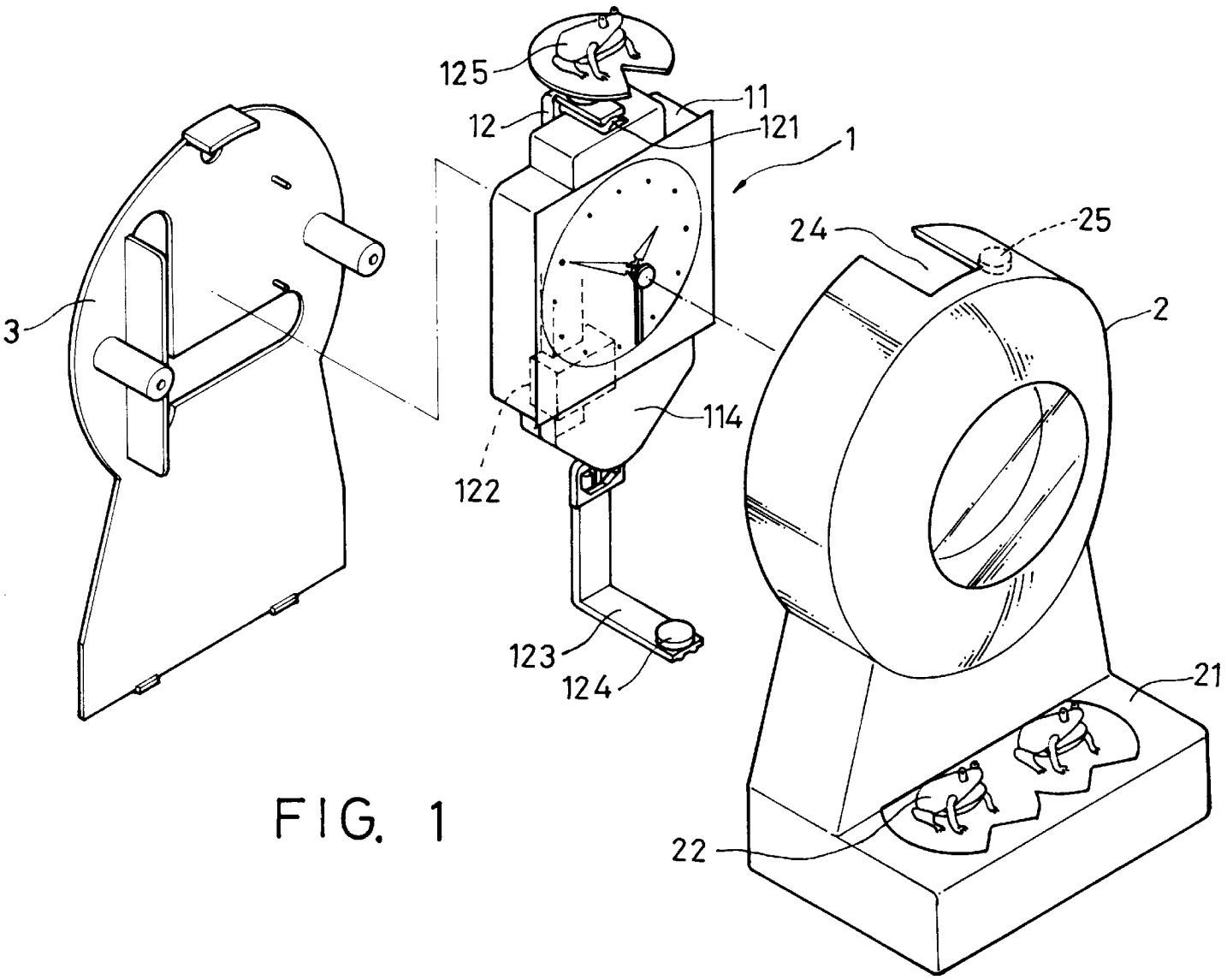
FIG. 1 is a perspective exploded view of a first preferred embodiment of the present invention.

The power device 1 includes a core 11 that has output shafts for time indication, such as an hour shaft 111, a minute shaft 112, and a second shaft 113. The power device 1 further has a swing lever 12 pivotally connected to a rear side thereof. The swing lever 12 has a pivot shaft 121 disposed above the core 11 so that the swing lever 12 is swingable using the pivot shaft 121 as an axis. An intermediate section of the swing lever 12, i.e., the portion of the swing lever 12 that corresponds to a lower portion of the core 11, is provided with a swing magnet 122 having a magnet. The core 11 is provided with an induction coil 114 at a corresponding position. By means of the cooperation of the induction coil 114 and the swing magnet 122, the swing lever 12 can swing harmoniously (as is known in the art). In addition, at a lower end of the swing lever 12, there is provided a lever plate 123 that is substantially L-shaped and bends in the direction of the base 2 after being assembly. A lever magnet 124 is provided on the lever plate 123. Furthermore, an upper end of the swing lever 12, i.e., the end of the swing lever 12 that is exposed on an upper portion of the base 2 after assembly, is provided with a swing ornament 125. The swing ornament 125 is swingable with the movement of the swing lever 12. As illustrated in the preferred embodiment of FIGS. 1 to 3, the swing ornament 125 is a frog that is provided with a pivot between an upper jaw and a lower jaw such that the lower jaw is movable with respect to the upper jaw. Additionally, an ornament magnet 126 is provided at a bottom portion of the lower jaw so as to be capable of action with respect to the base 2.

The base 2 is connected to the core 11, and is hollow so that the power device 1 can be accommodated therein. On a front side of the base 2 at an upper portion, there is the above-mentioned time indication, which is readable via a transparent window. A lower portion of the base 2 extends forwardly to form a hollow and enclosed base platform 21. At least one base ornament 22 is fixedly disposed on the base platform 21. A base magnet 23 is disposed on a bottom portion of the base ornament 22 to cooperate with the above-mentioned lever magnet 124. Like the above-mentioned swing ornament 125, the base ornament 22 is in the form of a frog that has inter-movable upper and lower jaws so that when the lever magnet 124 is proximate to the base ornament 22, the lower jaw is opened or closed with respect to the upper jaw to add liveliness to the present invention. In addition, on the upper portion of the base 2, there is provided a base notch 24 for passage of the swing lever 12. On one side of the base notch 24, i.e., on a top wall of the base 2 where the swing ornament 125 may reach, there is attached a top magnet 25 for cooperative action with the ornament magnet 126.

The back cover 3 is a plate-like cover structure that has a shape corresponding to the base 2 so that it can cover the latter to hide the power device 1 therein.

Figure 2:
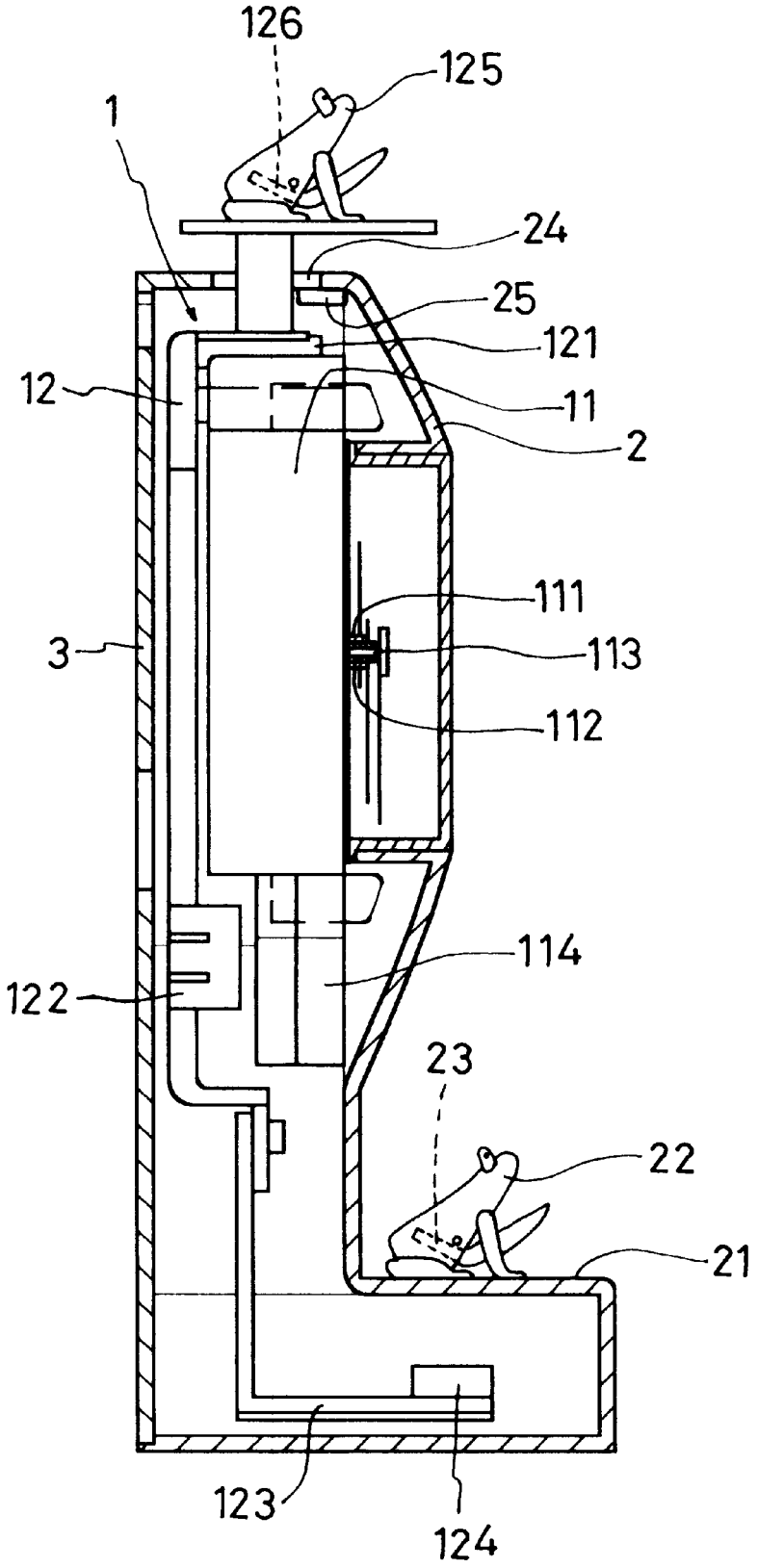
FIG. 2 is a sectional assembled view of the first preferred embodiment of the present invention.
Figure 3:
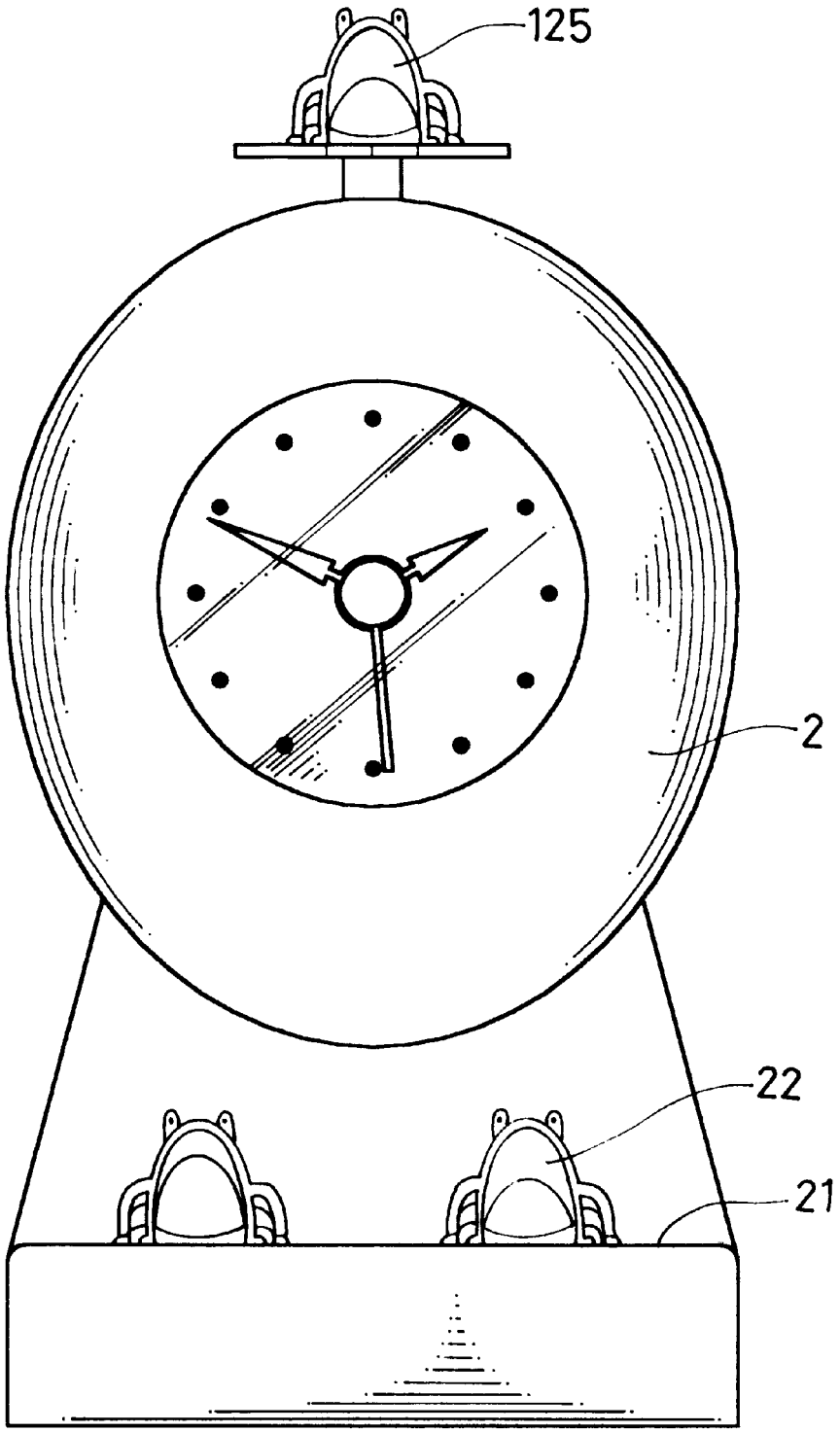
FIG. 3 is a front elevation of the first preferred embodiment of the present invention.

After assembly, as shown in FIGS. 2 and 3, the core 11 may be an output of time that can be read from the time indication. Due to the arrangement of the induction coil 114 and the swing magnet 122, the swing lever 12 is capable of harmonious swinging movement. At the same time, the swing ornament 125 on the upper end of the core 11, and the lever plate 123 and lever magnet 124 on the lower portion of the power device 1 simultaneously swing in different directions. And when the swing ornament 125 is proximate to the top magnet 25 on the top wall of the base 2, due to the action of the magnets 25 and 126, the lower jaw of the swing ornament 125 will open or close due to magnetic attraction or repulsion. But when the swinging is free from the magnetic action, it will reset. In this way, opening and closing of the mouth of the swing ornament 125 can be achieved.

In addition, the lever magnet 124 at the lower portion of the swing lever 12 swings synchronously. When the lever magnet 124 is proximate to the base ornament 22, it acts on the base magnet 23 so that the lower jaw of the base ornament 22 also opens or closes due to magnetic attraction or repulsion. But when it is removed from the range of the magnetic force, it will resume its original state.

In view of the aforesaid, it can be appreciated that the present invention not only can indicate time, but it also has a lever ornament that is disposed on a top portion thereof and that can swing and/or has a mouth portion capable of opening and closing, and a base ornament that is disposed on a base platform and that has a mouth portion capable of opening and closing, thus providing at least two visual effects.

Figure 4:
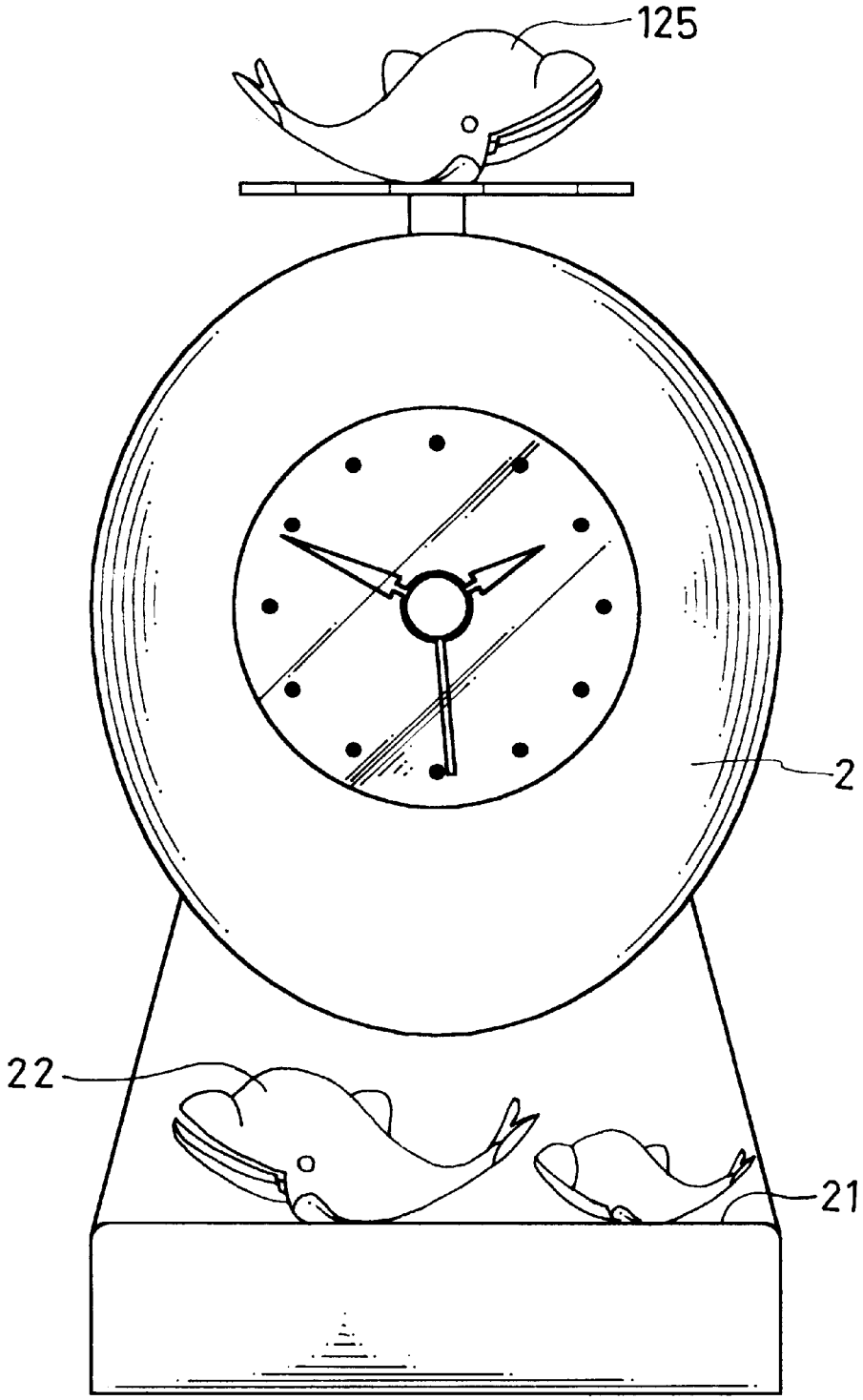
FIG. 4 is a front elevation of a second preferred embodiment of the present invention.

FIG. 4 shows another preferred embodiment of the present invention. In this embodiment, the ornaments are in the form of a dolphin instead of a frog.

Although the present invention has been illustrated and described with reference to the preferred embodiment thereof, it should be understood that it is in no way limited to the details of such embodiment but is capable of numerous modifications within the scope of the appended claims.

What is claimed is:

1. A clock assembly having magnetic ornaments, comprising:

a power device that includes a core having a time indication output and an induction coil at a lower portion thereof, and a swing lever pivotally connected to a rear side thereof by means of a pivot shaft capable of relative movement, said swing lever having an intermediate section provided with an ornament magnet corresponding to said induction coil at said lower portion of said core, and a lower end of said swing lever having a forwardly bent lever plate, said lever plate having a lever magnet provided thereon, said swing lever further having a swing ornament disposed at a top end thereof;

a base that is a hollow housing accommodating and securing therein said power device, an upper portion of said base being provided with a window adapted for matching said time indication output, a lower portion of said base extending forwardly to form a base platform, at least one base ornament being disposed on said base platform, said base ornament having a swingable portion and being connected by means of a pivot, a bottom portion of said base ornament being provided with an ornament magnet, said base further having a notch at a top end thereof for passage of said swing lever;

said induction coil and said swing magnet cooperating to cause said swing lever to swing to thereby cause said swing ornament to swing, the magnetic action of said lever magnet at said lower end of said swing lever causing said movable portion of said base ornament to move upwardly and downwardly.

2. The clock assembly having magnetic ornaments as defined in claim 1, wherein said swing ornament is provided with a movable portion that has a pivot, and an ornament magnet on a bottom portion thereof, said base being further provided with a top magnet on a top wall thereof where the magnetic force has influence, so that the magnetic force can cause said movable portion of said swing ornament to move upwardly and downwardly.

3. The clock assembly having magnetic ornaments as defined in claim 1, wherein said base ornament and said swing ornament have the same shape.

4. The clock assembly having magnetic ornaments as defined in claim 3, wherein said movable portions are lower jaws of said base ornament and said swing ornament.

5. The clock assembly having magnetic ornaments as defined in claim 4, wherein said swing ornament and at least one base ornament are disposed in different positions.

6. The clock assembly having magnetic ornaments as defined in claim 1, further comprising a back cover that is sized to match said base so as to close said base so that said power device accommodated in said base will not be exposed on the outside.

7. The clock assembly having magnetic ornaments as defined in claim 2, wherein said base ornament and said swing ornament have the same shape.

8. The clock assembly having magnetic ornaments as defined in claim 7, wherein said movable portions are lower jaws of said base ornament and said swing ornament.

9. The clock assembly having magnetic ornaments as defined in claim 8, wherein said swing ornament and at least one base ornament are disposed in different positions.

10. The clock assembly having magnetic ornaments as defined in claim 2, further comprising a back cover that is sized to match said base so as to close said base so that said power device accommodated in said base will not be exposed on the outside.

* * * * *